US005883363A

United States Patent [19]

Motoyoshi et al.

[11] Patent Number: 5,883,363

[45] Date of Patent: Mar. 16, 1999

[54] HEATING MANTLE AND METHOD FOR FABRICATING THE SAME

[75] Inventors: Yoshiyuki Motoyoshi, Kawasaki; Kohei Taguchi, Ikaruga, both of Japan

[73] Assignees: Nichias Corporation, Tokyo; Thermos Corporation, Nare-ken, both of Japan

[21] Appl. No.: 904,974

[22] Filed: Aug. 1, 1997

[30] Foreign Application Priority Data

Aug. 12, 1996 [JP] Japan ..... 8-229311
Aug. 12, 1996 [JP] Japan ..... 8-229312

[51] Int. Cl.[6] ..... H05B 3/34; H05B 3/58

[52] U.S. Cl. ..... 219/529; 219/535; 219/549

[58] Field of Search ..... 219/523, 528, 219/529, 535, 202; 428/286

[56] References Cited

U.S. PATENT DOCUMENTS 3,374,338 3/1968 Morey ..... 219/529
5,197,595 3/1993 Coultas ..... 219/129

FOREIGN PATENT DOCUMENTS 0 295 351 12/1988 European Pat. Off. .
41 35 082 12/1992 Germany .
2-31676 8/1990 Japan .
2 278 262 11/1994 United Kingdom .

*Primary Examiner*—Teresa Walberg
*Assistant Examiner*—Sam Paik
*Attorney, Agent, or Firm*—Flynn, Thiel, Boutell & Tanis, P.C.

[57] ABSTRACT

In order to provide a heating mantle so composed that fixing and unfixing work can be carried out simply and easily and in addition a good thermal uniformity can be obtained, the heating mantle is fabricated by a method, by which sewing by means of a sewing machine is carried out on a sheet-shaped heat resistant and heat insulating core member, using a heating wire, which is a yarn of metal fine wires, for a lower yarn and a glass yarn for an upper yarn; a predetermined heating wire pattern is formed on a surface of the core member; and a layered body consisting of the core member with the heating wire and covering members made of glass cloth, which are laid on upperside and underside thereof, is enclosed by a sack-shaped cover member.

By the heating mantle thus constructed winding around a piping is simple and easy and there is no risk that deviation of the heating wire takes place so that a good thermal uniformity with respect to the piping can be exhibited. Moreover, owing to the fact that the heating wire is used for the lower yarn for the sewing machine, it is possible to form easily the predetermined heating wire pattern.

8 Claims, 6 Drawing Sheets

HEATING MANTLE AND METHOD FOR FABRICATING THE SAME

FIELD OF THE INVENTION

The present invention relates to a heating mantle, and a method for fabricating the same and in particular to an improvement of a heating mantle suitable for keeping piping, joints, valves, etc. e.g. for precision machines and apparatuses, etc. (hereinbelow called piping, etc.) warm or heating them, and a method for fabricating the same.

DESCRIPTION OF THE PRIOR ART

Heretofore, for heating piping for precision machines and apparatuses, etc., there is known a composition, in which a covering heating wire such as a nichrome wire is wound in the form of a spiral around the piping on the outer surface thereof and a band-shaped heat insulating material made of inorganic fiber is wound further thereon for preventing heat transmission.

Although the above mentioned heaters has a simple composition, a considerable work is necessary for winding a heating wire. In addition, in case where there exist joints, valves, branched pipes, etc., a manner of winding the heating wire and a manner of making electric current flow therethrough are complicated so that workability is very bad. Further, unless the heating wire is wound with a constant pitch, there is a drawback that thermal uniformity with respect to the piping is damaged. Furthermore, when it is unfixed at maintenance, inspection, etc. of the piping, the heating wire should be rewound again.

SUMMARY OF THE INVENTION

The present invention has been made in view of the above problems and an object thereof is to provide a heating mantle, so composed that fixing and unfixing work to piping, etc. can be carried out easily and a good thermal uniformity with respect to the piping, etc. can be obtained, and a method for fabricating the same.

A heating mantle according to the present invention is characterized in that it comprises a sheet-shaped core member having a flexibility and a resistance to heat; a heating wire fixed with a predetermined pattern on a surface of the core member; a sheet-shaped covering member having a flexibility and a resistance to heat or a sheet-shaped heat insulating member having a flexibility and a resistance to heat, which is laid on the core member on the side of the heating wire; and a sack-shaped cover member having a flexibility and a resistance to heat enclosing a layered body of the core member with the heating wire and the covering member or the heat insulating member.

Further a method for fabricating a heating mantle according to the present invention is characterized in that a heating wire is fixed on a surface of a sheet-shaped core member having a flexibility and a resistance to heat by means of a sewing machine, disposed with a predetermined pattern; a sheet-shaped covering member having a flexibility and a resistance to heat or a sheet-shaped heat insulating member having a flexibility and a resistance to heat is laid on the core member on the side of the heating wire pattern, and these members are enclosed by a cover member having a flexibility and a resistance to heat in a form of a sack.

For the core member, the covering member or the heat insulating member and the cover member constituting a principal part of the heating mantle according to the present invention, it is preferable to use sheet-shaped cloths or mats made of inorganic fiber such as glass fiber, ceramic fiber, etc. However, any other material can be suitably selected to be used, if it has a flexibility, a resistance to heat and an electric insulation. Concerning the cover member, it is desirable to attach bands with clasps thereto for fixing and maintaining a heating mantle so that it does not get off the piping after having been wound thereon.

The heating wire sewn on the core member by means of a sewing machine may be single, but since a thick single wire is rigid, it is difficult to deal with it by means of the sewing machine. Instead of the single wire, metal fine wires can be used. A wire obtained by twisting a required number of metal fine wires having a diameter of several micrometers has a flexibility and moreover a satisfactory strength, and therefore it is suitable for fixing it by means of a sewing machine. For yarn used for surfaces where no heat generation is required it is preferable to use yarn having an electric insulation e.g. such as glass yarn.

As a method for forming a heating wire pattern on the core member by means of a sewing machine, there is known a method wherein a heating wire, which is e.g. twisted metal fine wires, is used for a lower yarn for the sewing machine, while a glass yarn is used for an upper yarn, and the core member is put on a table of the sewing machine and moved forward and backward and to the left and the right similarly to usual sewing by means of a sewing machine to form a predetermined pattern of the heating wire.

There is another method, wherein a drawing of a heating wire pattern prepared in advance on the basis of a design is laid on the core member and the heating wire is sewn while tracing the pattern drawn on the drawing, the drawing being removed thereafter.

By the former method, since the heating wire pattern is formed while sewing by means of the machine, a fair skill is required. On the other hand, by the latter method, since it is sufficient to trace the heating wire pattern drawn on the drawing, it is easy to sew-on the heating wire and therefore workability is good.

Further there is an automatic sewing system using computer control. By this system, at first, a predetermined heating wire pattern is designed by using a CAD; instructions from the CAD are stored in a memory of a programming device; the programming device is connected with an industrial computer-aided sewing machine through a cable; and the heating wire is sewn on the core member according to the wiring pattern, while moving a movable table on the machine side supporting the core member according to instructions from the computer. By this method it is possible to realize full automation from preparation of the drawing of desired heating wire pattern to work of sewing the heating wire on the core member.

DESCRIPTION OF THE PREFERRED EMBODIMENTS

Figure 1:
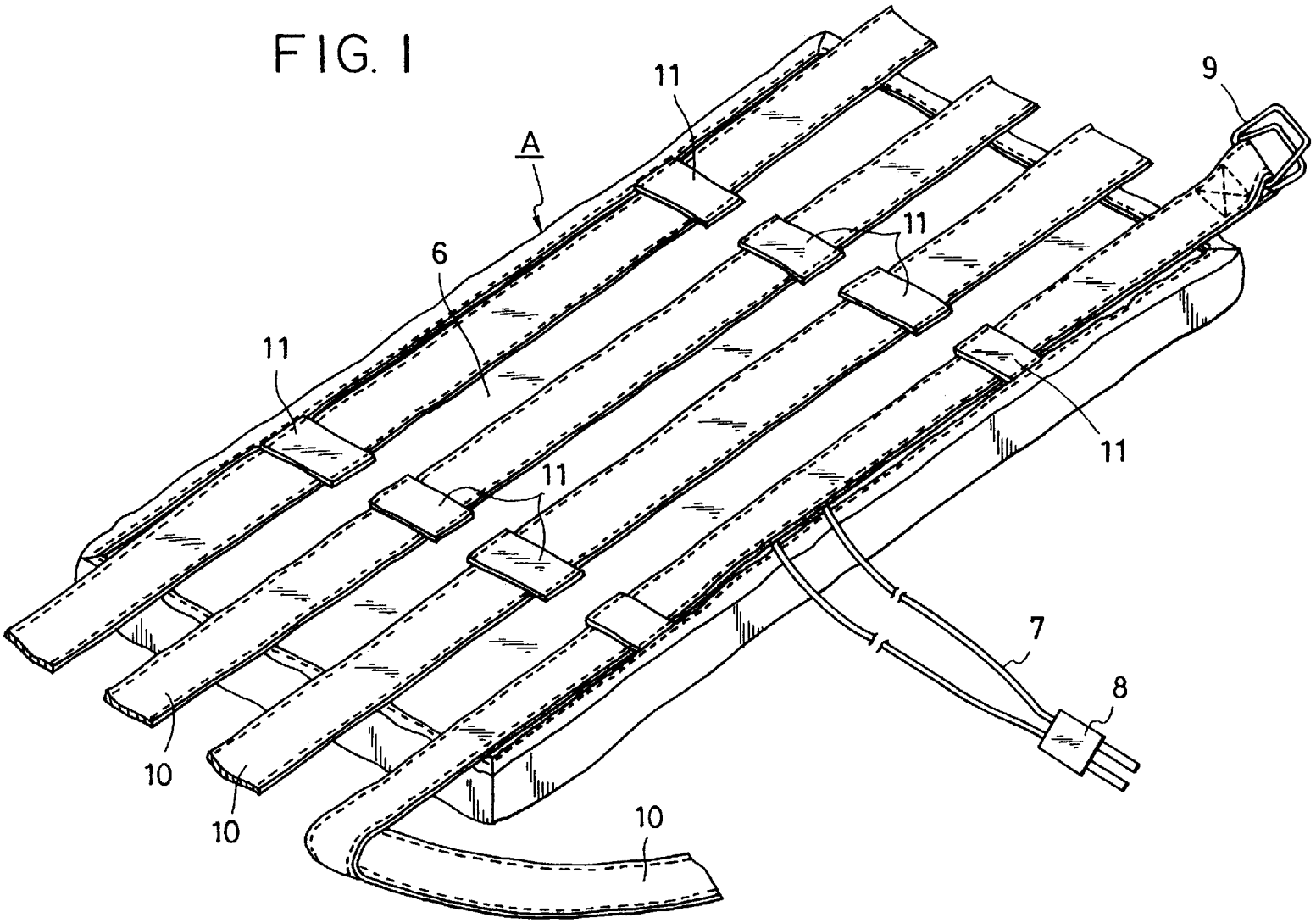
FIG. 1 is a perspective view of a heating mantle, which is an embodiment of the present invention.
Figure 2:
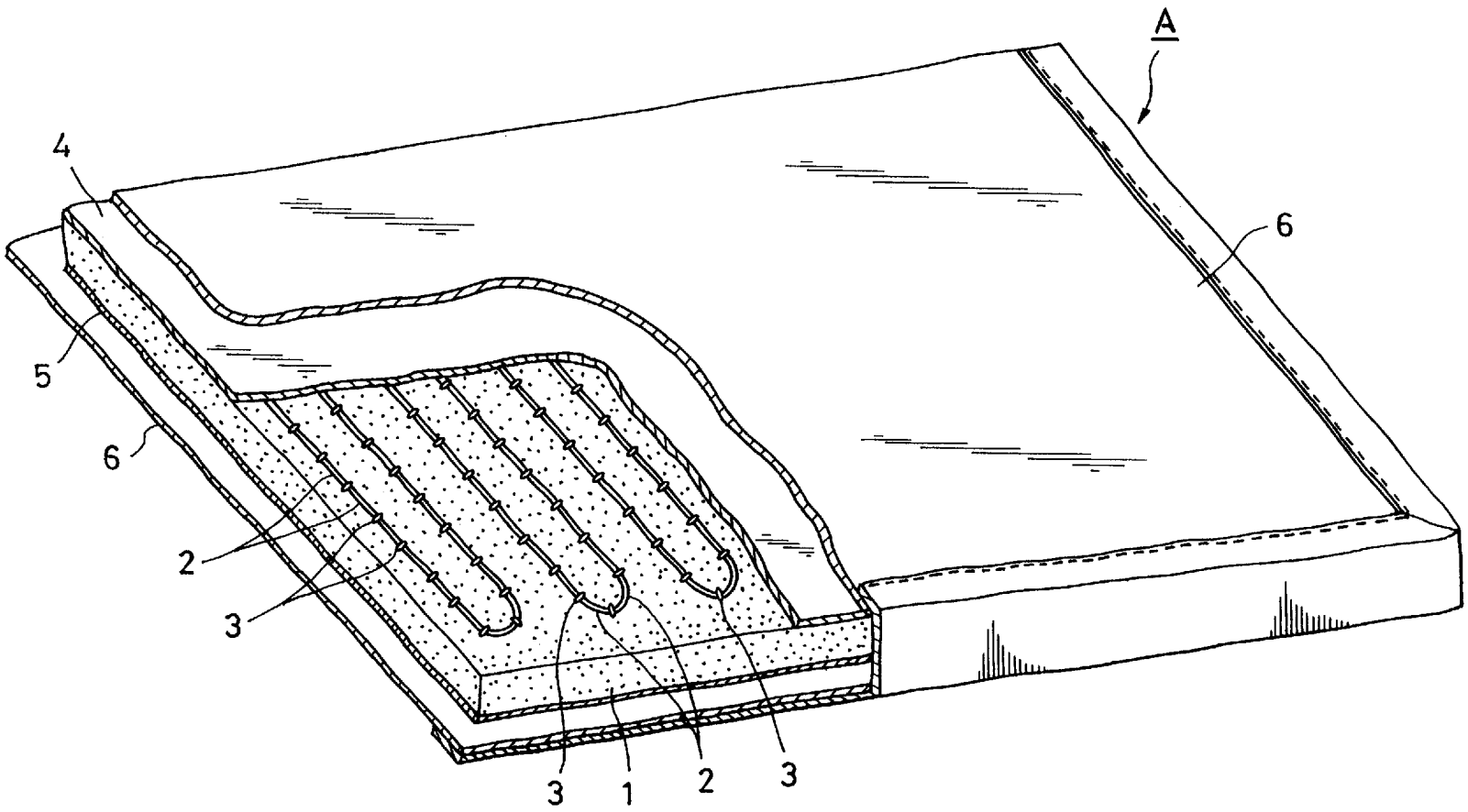
FIG. 2 is an enlarged perspective view of a part of the heating mantle partly cut-off.
Figure 3:
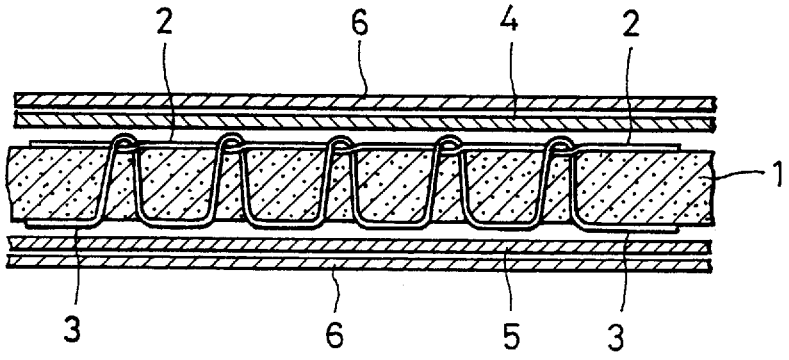
FIG. 3 is an enlarged cross-sectional view of a part of the heating mantle.

FIGS. 1 to 4 show a preferred embodiment of the present invention.

In the figures, a heating mantle A is so composed that a predetermined heating wire pattern is sewn by means of a sewing machine on a surface of a core member 1 having a flexibility made of a heat insulating resin porous body, an inorganic fiber blanket, a heat resistant rubber sheet, etc. by using a heating wire 2 consisting of a yarn of metal fine wires for a lower yarn and a heat resistant yarn 3 made of glass fiber, etc. for an upper yarn to form a predetermined pattern; heat resistant and electrically insulating sheet-shaped covering members 4 and 5 made of glass cloth, etc. are laid on upperside and underside of the core member 1 with the heating wire; layered body thus obtained is enclosed by a heat resistant electrically insulating sheet-shaped cover member 6 made of glass cloth, etc.; and a terminal or a connector 8 is fixed on leads 7 taken out for connecting them with a power supply through a part of the cover member 6.

In FIGS. 1 to 4, A is a heating mantle and 1 is a sheet-shaped core member made of silicone sponge. A predetermined heating wire pattern is sewn on this core member 1 by means of a sewing machine using a heating wire 2 formed by twisting nichrome fine wires for a lower yarn and a glass yarn 3 for an upper yarn. 4 and 5 are sheet-shaped covering members made of glass cloth laid on upperside and underside, respectively, of the core member 1 with the heating wire. The covering member 4 on the side of the heating wire facing the piping is used mainly for the purpose of improving electric insulation and thermal uniformity, while the covering member 5 on the opposite side is used mainly as a heat insulating member for preventing heat transmission. The layered body consisting of the core member 1 with the heating wire and the covering members 4 and 5 is enclosed by a sheet-shaped cover member 6 made of glass cloth. For this cover member 6 made of glass cloth it is preferable to use glass cloth coated with fluorocarbon resin for the purpose of making it dust-proof.

The two ends of the heating wire 2 sewn on the core member 1 with a predetermined pattern are taken out outside through leads 7 passing through predetermined places of the cover member 6 and a connector 8 for connecting them with a power supply is attached thereto.

A plurality of belts 10 made of heat resistant cloth having clasps 9 are sewn on an end portion of the cover member 6 and belt guides 11 made of a similar material are sewn on predetermined places on the surface.

Figure 4:
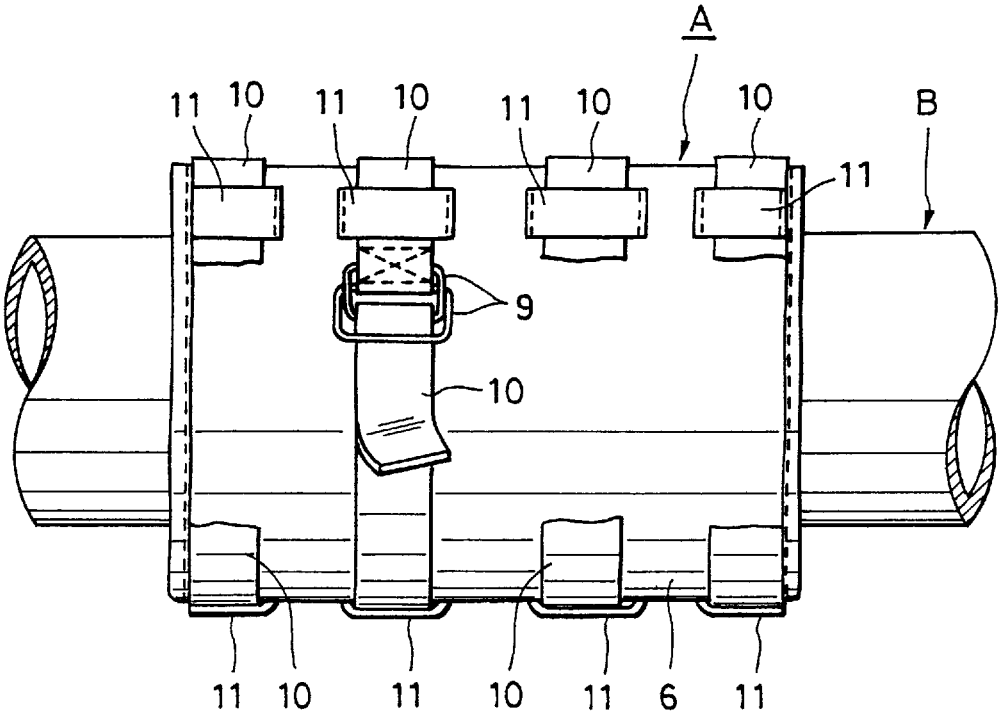
FIG. 4 is a side view of the heating mantle in a state where it is fixed to a piping.

FIG. 4 shows a state where the heating mantle A thus composed is wound around a straight pipe B and fastened thereon by means of the belts 10 with the clasps 9. Instead of the clasps 9, easily fixable and unfixable fasteners called usually "magic tapes" can be used therefor.

Work for fixing the heating mantle thus composed to a piping and work for unfixing it at maintenance or inspection can be carried out simply and easily. Further, since there is no risk of deviation of the heating wire, a good thermal uniformity with respect to the piping can be exhibited.

In addition, it is possible to fabricate easily heating mantles having any shapes not only for straight pipes but also for elbows, branches, and pipings having various shapes.

In particular, since the heating mantle is so composed that a heating wire is sewn on a core member with a predetermined pattern by means of a sewing machine, using the heating wire as a lower yarn for the sewing machine, it is possible to obtain a core member with a heating wire without trouble. Moreover it is possible also to adopt an automatic sewing system using computer control and to lower fabrication cost of the heating mantle.

A concrete fabrication process of the heating mantle indicated in FIGS. 1 to 4 will be described below.

At first, a developed view of a piping, to which the heating mantle should be fixed, is prepared by means of a CAD. A required resistance of the heating wire is obtained by using a cross-sectional area of the piping and a length of the heating wire described later is calculated. Then, a pitch of the heating wire and a wiring pattern thereof are additionally drawn on the developed view obtained by means of the CAD to prepare a drawing of the heating wire pattern.

A silicone sponge 5 mm thick is used for the core member. The drawing of the heating wire pattern is laid on a surface of the core member after having cut it in a predetermined form and fixed provisionally thereto by means of a thread, etc. so as not to move.

An industrial sewing machine is used for the machine, in which a glass yarn coated with fluorocarbon resin is used for the upper yarn, while a heating wire obtained by twisting 3 metal fine wires having a diameter of 0.05 $\mu$m and further by twisting 7 yarns of metal fine wires thus obtained is used for the lower yarn.

Sewing by means of the machine is carried out while tracing the heating wire pattern in the drawing laid on the surface of the core member. The core member with the heating wire is obtained by removing the drawing after having terminated the sewing.

Next covering members made of glass cloth are laid on upperside and underside of the core member with the heating wire and the whole is enclosed by a cover member made of glass cloth coated with fluorocarbon resin, which is sewn so as to be a sack. At this time, leads for the heating wire are taken out through holes formed in the cover member at predetermined positions. A connector for connecting them with a power supply is fixed thereon and belts with clasps and belt guides are sewn on the cover member at predetermined places to obtain the heating mantle for a straight pipe.

Figure 5:
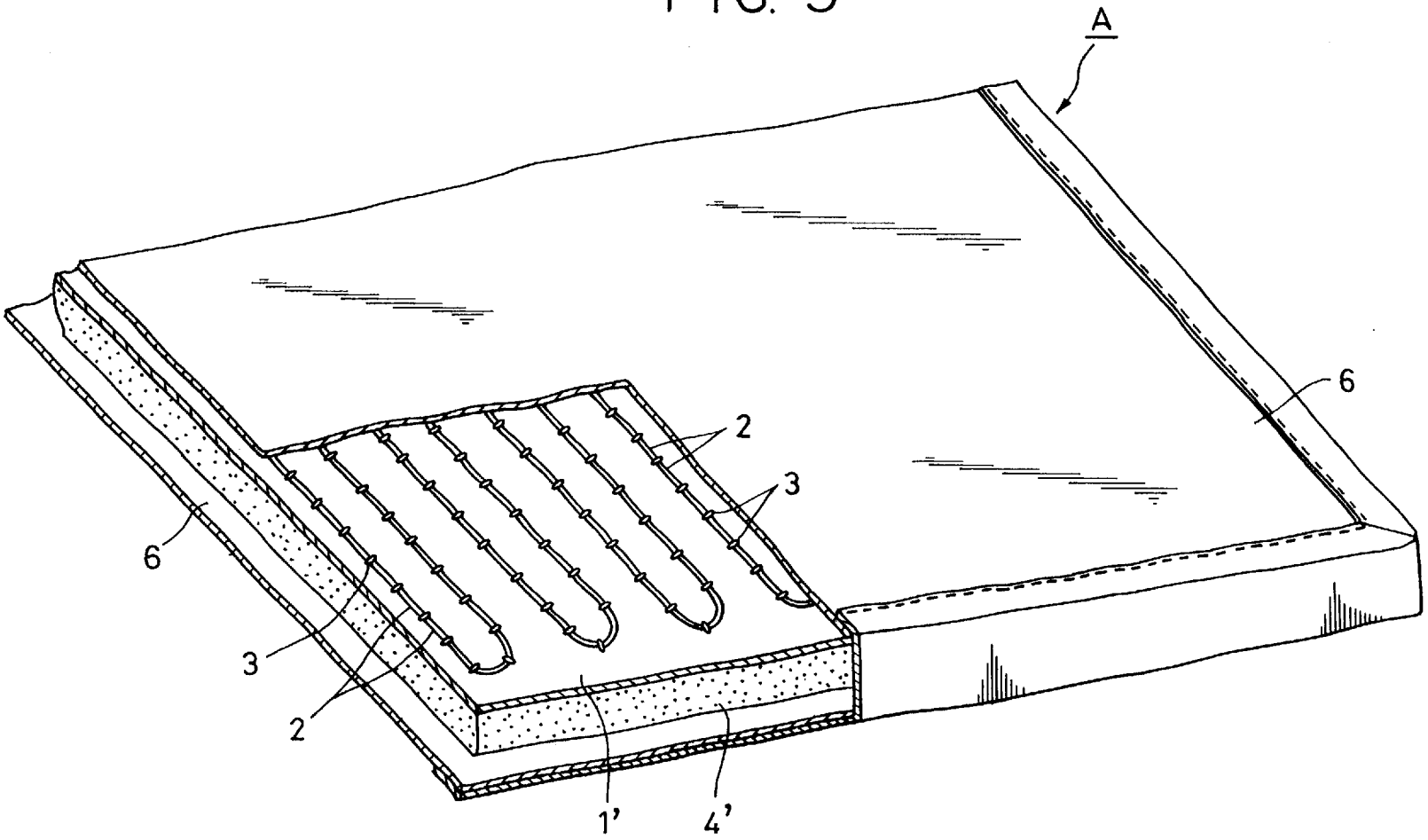
FIGS. 5 and 6 are enlarged perspective views of heating mantle, which are other embodiments of the present invention, partly cut-off.
Figure 6:
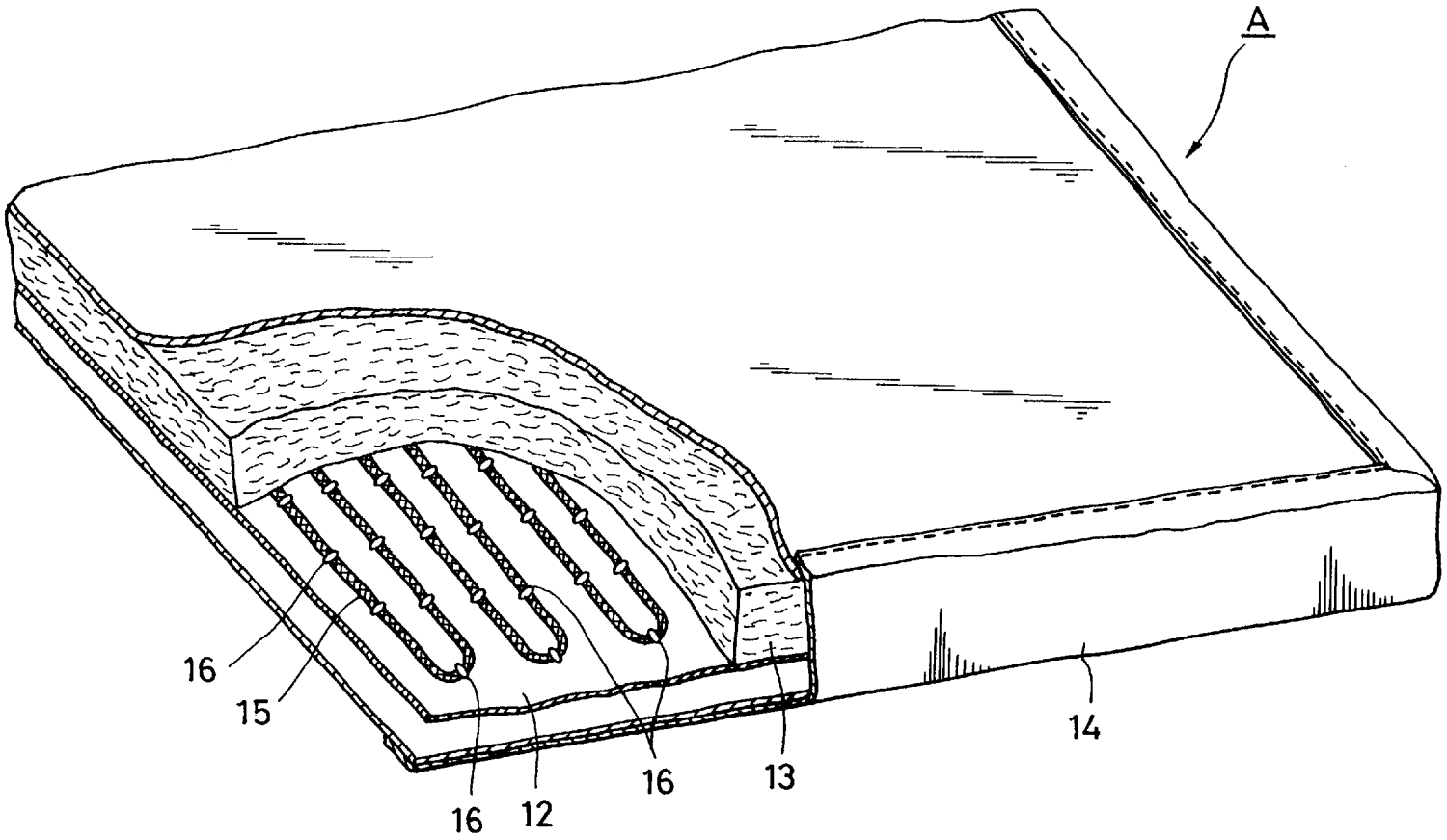

FIGS. 5 and 6 show heating mantle according to other embodiments of the present invention.

In the embodiment indicated in FIG. 5, heat resistant electrically insulating cloth such as glass cloth, etc. is used for the core member 1', on which the heating wire 2 is sewn with a predetermined pattern by means of a sewing machine similarly to the preceding embodiment. 3 is a glass yarn serving as the upper yarn and 4' is a sheet-shaped covering member made of silicone sponge, which is used as a heat insulating member for preventing heat transmission. 6 is a cover member.

In the embodiment indicated in FIG. 6, A is a heating mantle; 12 is a core member made of glass cloth (0.26 mm thick); 13 is a heat insulating member made of glass fiber mat (4 to 10 mm thick); and 14 is a sack-shaped cover member made of glass cloth (0.11 mm thick). For this cover member glass cloth coated with fluorocarbon resin is used for the purpose of making it dust-proof.

On a surface of the core member 12 a covered heating wire 15, in which a nickel-chrome wire is covered by a glass sleeve, is disposed in a zigzag pattern and sewn thereon with a glass yarn 16. A mat-shaped heat insulating member 13 is laid on the core member 12 with heating wire and these members are enclosed by a cover member 14.

As described in detail in the above, according to the present invention, work for fixing a heating mantle to a piping and unfixing it therefrom is not troublesome and it can be fixed simply and easily and moreover a good thermal uniformity with respect to the piping can be exhibited. In addition, a heating mantle can be obtained, in which a heating wire can be formed in a predetermined heating wire pattern by means of a sewing machine.

What is claimed is:

1. A heating mantle for heating or keeping warm a pipe, comprising:

a sheet-shaped core member having a flexibility and a heat insulating characteristic;

a heating wire fixed in a selected pattern to a surface of said core member;

at least one of a sheet-shaped covering member having a flexibility and a resistance to heat characteristic and a sheet-shaped heat insulating member having a flexibility and a resistance to heat characteristic which is laid on said core member on the side thereof facing said heating wire;

a sack-shaped cover member having a flexibility and a resistance to heat characteristic enclosing a layered body of said core member with said heating wire and said at least one of said covering member and said heat insulating member; and fastening means for facilitating a wrapping of said heating mantle around the piping and fastening it thereto.

2. The heating mantle according to claim 1, wherein said core member is a heat resistant glass cloth; wherein said covering member is a mat made of glass fiber; and wherein said cover member is a heat resistant and electrically insulating glass cloth.

3. The heating mantle according to claim 2, wherein said glass cloth cover member is coated with fluorocarbon resin.

4. The heating mantle according to claim 1, wherein said core member is a silicone sponge.

5. The heating mantle according to claim 4, wherein said silicone sponge is 5 mm thick.

6. A method for fabricating a heating mantle, comprising the steps of:

sewing by means of a sewing machine a heating wire to a surface of a sheet-shaped core member having a flexibility and a resistance to heat characteristic in a specified pattern;

laying at least one sheet-shaped covering member having a flexibility and a resistance to heat characteristic or at least one sheet-shaped heat insulating member having a flexibility and a resistance to heat characteristic on said core member on the side of said heating wire; and enclosing the aforesaid members with a cover member in the form of a sack having a flexibility and a resistance to heat characteristic.

7. The method for fabricating a heating mantle according to claim 6, wherein a heating wire pattern drawing is prepared and said heating wire is sewn on said core member along a heating wire pattern, based on said drawing laid over said core member, and thereafter removing the drawing.

8. The method for fabricating a heating mantle according to claim 6, wherein said heating wire is sewn on said core member by means of a sewing machine controlled by drawing data of said heating wire pattern prepared by using a CAD and laid over said core member, and thereafter removing the drawing.

* * * * *